US005874688A

United States Patent [19]

Lübbe et al.

[11] Patent Number: 5,874,688

[45] Date of Patent: Feb. 23, 1999

[54] EXPLOSIVES DISPERSED FROM A PRESSURIZED CONTAINER

[75] Inventors: Carl Hermanus Lübbe, Kempton Park; Laurence Justin Pienaar Wislon, Modderfontein; Colin Douglas Wilson, Craighall Park; Keith Anthony Jordan, Eden Glen, all of South Africa

[73] Assignee: AECI Explosives Limited, South Africa

[21] Appl. No.: 721,491

[22] Filed: Sep. 27, 1996

Related U.S. Application Data

[63] Continuation of Ser. No. 344,935, Nov. 23, 1994, abandoned.

[30] Foreign Application Priority Data

Nov. 29, 1993 [ZA] South Africa ..... 93/8909

[51] Int. Cl.[6] ..... F42B 3/00; F42D 3/00

[52] U.S. Cl. ..... 86/20.15; 102/290; 102/302; 102/312; 102/313

[58] Field of Search ..... 102/290, 302, 102/312, 313; 86/20.15

[56] References Cited

U.S. PATENT DOCUMENTS

| | | | |
|---|---|---|---|
| 2,925,038 | 2/1960 | Walker | 102/302 |
| 3,303,738 | 2/1967 | Clay et al. | 86/20.15 |
| 3,617,401 | 11/1971 | Mortensen et al. | 149/2 |
| 3,642,547 | 2/1972 | Conrad | 149/2 |
| 3,774,496 | 11/1973 | Roach | 86/20.15 |
| 4,294,633 | 10/1981 | Clay | 149/2 |
| 5,067,995 | 11/1991 | Nutt | 149/2 |

*Primary Examiner*—Peter A. Nelson

[57] ABSTRACT

The invention provides a method and apparatus (10) for loading a sensitized flowable explosive into a borehole. The apparatus (10) is portable and comprises containers 14, 16 which are pressurizable, for containing an explosive under pressure. Containers 14, 16 have closeable explosive inlets, closeable explosive outlets, and closable fluid inlets. In accordance with the method gas bubbles are dispersed into an explosive base to provide a sensitized explosive which is fed as a batch into the portable containers. The containers are pressurized to de-sensitize the explosive, after which the containers are conveyed to a borehole where the explosive is loaded from the apparatus into the borehole.

9 Claims, 2 Drawing Sheets

EXPLOSIVES DISPERSED FROM A PRESSURIZED CONTAINER

Figure 1:
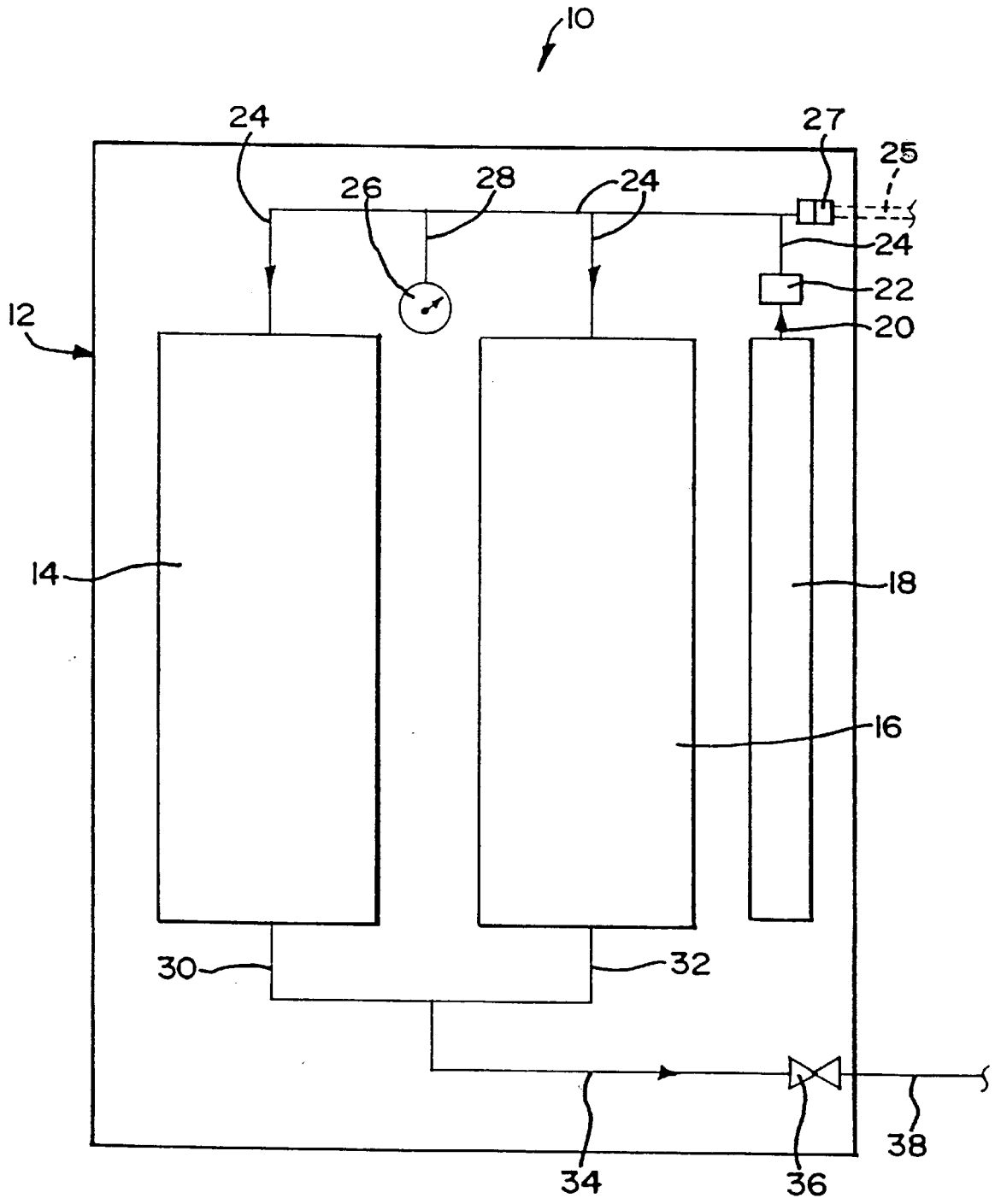

This is a continuation of application Ser. No. 08/344,935 filed on Nov. 23, 1994, and now abandoned.

THIS INVENTION relates to explosives. More particularly it relates to a method of and apparatus for loading a sensitized flowable explosive, particularly of the slurry or emulsion type, into a borehole.

According to one aspect of the invention there is provided a method of loading a sensitized flowable explosive into a borehole, the method comprising the steps of:

dispersing a plurality of gas bubbles in an explosive base to provide a sensitized explosive;

feeding a batch of the sensitized explosive into a portable container;

subjecting the batch of explosive in the container to an elevated pressure to desensitize it;

conveying the portable container containing desensitized explosive to a borehole; and loading the borehole with explosive from the container while relieving the pressure on the explosive to resensitize the explosive as it is loaded into the borehole.

Subjecting the batch to the elevated pressure may be effected after the feeding of the batch into the container. Instead, subjecting the batch to the elevated pressure may be effected during the feeding of the batch into the container.

Flowable explosives of the type in question may be explosives of the slurry or emulsion type, comprising an aqueous phase and an oil phase.

The explosive base may be an emulsion base having an aqueous phase containing ammonium ions, dispersing the bubbles in the explosive base being by dispersing a solution of nitrite ions in the base, nitrite ions in the dispersed solution reacting with ammonium ions in the aqueous phase in accordance with the reaction:

$$NH^+_4 + NO^-_2 \rightarrow 2H_2O + N_2$$

to produce dispersed gas bubbles in the form of nitrogen bubbles in the base. The solution of nitrite ions will typically be an aqueous solution, and the bubbles will reduce the density of the emulsion base to a suitable value to convert it into a sensitized explosive. This is conveniently carried out in a conventional manner in bulk at a central work station, eg in a gulley in a mine.

Thus, the dispersing of the bubbles may be into a bulk supply of explosive base, the method including feeding a plurality of batches of the sensitized explosive from the bulk supply into a plurality of said portable containers.

Loading the borehole with explosive from the container may comprise displacing the explosive from the container by means of a fluid under pressure.

Feeding the batch of explosive into the container will usually be by means of a suitable pump, although naturally, gravity and/or application of a fluid pressure such as water, gas or air pressure to the sensitized explosive may be used to feed it into the container.

The feeding of each batch of sensitized explosive into the container may be such that the container contains, in addition to the sensitized explosive, a gas space containing gas under pressure. In other words, feeding the batch into the container may be by feeding a gas under pressure into the container together with the batch to provide, in the container, in addition to the batch of explosive, a gas space containing gas under said elevated pressure, the gas in the gas space being used to displace the explosive from the container.

Instead, displacing the explosive from the container may be by means of gas under pressure obtained from a gas cylinder connected to the container.

Preferably, however, displacing the explosive from the container is by means of a fluid obtained from a fluid supply main releasably connected to the container. The fluid will usually thus be water or compressed air, obtained from a fluid supply main such as a water main or compressed air main, as the case may be.

Optionally, a stabilizing agent known in the art may be added to the base prior to sensitizing thereof, for stabilizing the sensitized explosive and maintaining it in a sensitized state. Preferably, stabilizing agents of limited solubility in the oil phase and insignificant solubility in the aqueous phase of the emulsion are employed, such as silicone-based surfactants. Examples of stabilizing agents, and the proportions in which they are used, are non-ionic fluorinated surfactants, such as Fluorad FC 740 (available from 3M in South Africa), which are dispersable in the oil phase and stabilize air/oil interfaces. The non-ionic fluorinated surfactants may be added to the emulsion in the range of 0,001–0,1% by mass, preferably 0,01–0,02% by mass, to achieve the desired bubble stabilizing effect.

As indicated above, the sensitized explosive will be desensitized in the container by pressurizing said sensitized explosive in the container to a desired pressure, thereby reducing the volume of the gas bubbles in the emulsion and increasing the density of the emulsion to form a non-detonatable desensitized emulsion.

The elevated pressure may have a value of 300 kPa–800 kPa, preferably 450 kPa–600 kPa, eg 500 kPa.

The container may be constructed from metal, eg steel, plastics material, composite materials including fibre-reinforced resins such as glassfibre reinforced resins, selected dependent on the pressures to be used in the container, and to be compatible with the explosive.

Conveying the container to the borehole may be on the back of a person, the container being carried as a back-pack by said person.

When loading the borehole with explosive from the container is by displacing the explosive from the container by means of a fluid under pressure as indicated above, this fluid pressure may be water pressure, air pressure or gas pressure, obtained eg from a water main, a compressed air main or a compressed air cylinder or gas cylinder. Thus, when the explosive is to be loaded into a borehole, the explosive may be displaced from the container by admitting gas or water under pressure to the container, thereby displacing the explosive from the container. Instead, as indicated above, the explosive may be displaced from the container by means of gas under pressure contained in a gas space in the container.

When the desensitized explosive is displaced from the container, the relief of pressure will allow the bubbles to increase in volume with a concomitant decrease in the density of the emulsion, thereby resensitizing the explosive.

When the explosive is loaded into the borehole, it may be displaced from the container along a lance into the borehole; and loading the borehole may thus be by means of a lance connected to the container by a flexible hose. The lance may have graduated markings located thereon to permit control of the amount of explosive loaded into the borehole. The loading of the borehole may include inserting the lance into the borehole, displacing the explosive from the container into the borehole by means of pressurized gas so that the explosive entering the borehole from the lance urges the lance from the borehole until a predetermined graduated marking on the lance appears, after which loading can be discontinued, an appropriate charge of explosive having been loaded into said borehole. In other words, in a particular embodiment of the method, the method may include using markings along the length of the lance to monitor the quantity of explosive loaded into the borehole, the method including inserting an end of the lance remote from the hose into the borehole, displacing explosive from the container along the lance into the borehole, allowing explosive entering the borehole along the lance to displace the lance from the borehole, and discontinuing the loading when the lance has been displaced from the borehole by a degree corresponding to the loading of a desired charge of explosive into the borehole.

It should be appreciated that once the container has been filled there will be a limited period during which the contents in the container must be used before the contents revert to an unstable state. This period will vary, being dependent on the type of explosive being used, stabilizers incorporated therein, the pressure in the container etc.

The explosive will typically be detonated in the borehole in the usual way, by means of a suitable detonator, which may be initiated by means of a suitable fuse or electrically, as known in the art.

According to another aspect of the invention there is provided portable apparatus for loading a charge of a sensitized explosive into a borehole, the apparatus comprising:

a pressurizable container for containing a batch of explosive under pressure;

a closeable explosive inlet into the container for admitting a batch of explosive from a supply thereof into the container;

a closeable explosive outlet from the container for permitting one or more charges of explosive to issue from the container;

a closeable fluid inlet into the container for admitting a gas under pressure into the container for displacing explosive from the container; and a gas cylinder for containing a gas under pressure and having a gas outlet connected to the fluid inlet into the container.

In a variation of this aspect of the invention there is provided a portable apparatus for loading a charge of sensitized explosive into a borehole, the apparatus being in the form of a back-pack for carrying on the back of a single person and comprising:

a pressurizable container for containing a batch explosive under pressure;

a closable explosive inlet into the container for admitting a batch of explosive from a supply thereof into the container;

a closable explosive outlet from the container permitting one or more charges of explosive to issue from the container; and a closable fluid inlet into the container for admitting a fluid under pressure into the container for displacing explosive from the container.

In use, connecting the fluid inlet to a supply of fluid under pressure, such as water, air or gas, can act to permit discharge of explosive through the explosive outlet, by admitting fluid to the container via the fluid inlet, to pressurize the container.

By referring to the apparatus as portable is meant that the apparatus, as described herein, can be manually moved or manipulated from place to place by one or two person(s).

The back-pack apparatus may also comprise a gas cylinder for containing a gas under pressure and having a gas outlet connected to the fluid inlet into the container.

The explosive outlet may be connected, eg releasably, to a charging pipe or lance by means of a flexible hose. The lance may be graduated with markings along its length to permit control of the amount of explosive being loaded into the borehole. Thus, in a particular embodiment of the apparatus, the apparatus may comprise a lance and a flexible hose, the flexible hose having an inlet connected to the explosive outlet from the container and an outlet, the lance having an inlet connected to the outlet of the hose and a free end remote from its inlet; and in this case the lance may have markings along its length to permit monitoring of the depth to which it is inserted, free end first, into a borehole. The apparatus may, as indicated above, be in the form of a back-pack for carrying on the back of a single person.

When the apparatus is in the form of a back-pack, it may comprise a framework which supports the container, which construction permits the apparatus to be carried on the back of a person operating the apparatus.

While the explosive inlet into the container and the fluid inlet into the container may be separate from each other, the explosive inlet may also act as the fluid inlet, i.e. the explosive inlet and the gas inlet of the container may be in the form of a common closable inlet into the container.

In principle, the substance method can be employed without desensitizing the explosive in the container.

Thus, according to a further aspect of the invention there is provided a method of loading a sensitized flowable explosive into a borehole, the method comprising the steps of:

dispersing a plurality of gas bubbles in an explosive base to provide a sensitized explosive;

feeding a batch of the sensitized explosive into a portable container;

conveying the portable container containing said explosive to a borehole; and loading the borehole with explosive from the container.

Features of this invention may be as described above. Thus, in particular loading the backpack with explosive from the container may comprise displacing the explosive from the container by means of a fluid under pressure; but displacing the explosive from the container may instead be by means of gas under pressure obtained from a gas cylinder connected to the container. Displacing the explosive from the container may instead be by means of a fluid obtained from a fluid supply main releasably connected to the container; and conveying the container to the borehole may be on the back of a person, the container being carried as a back-pack by said person. Loading the borehole may be by means of a lance connected to the container by a flexible hose. The method may include using markings along the length of the lance to monitor the quantity of explosive loaded into the borehole, the method including inserting an end of the lance remote from the hose into the borehole, displacing explosive from the container along the lance into the borehole, allowing explosive entering the borehole along the lance to displace the lance from the borehole, and discontinuing the loading when the lance has been displaced from the borehole by a degree corresponding to the loading of a desired charge of explosive into the borehole.

According to a still further aspect of the invention there is provided a portable apparatus for loading a charge of sensitized explosive into a borehole, the apparatus being in the form of a back-pack for carrying on the back of a single person and comprising:

a container for containing a batch of explosive;

an inlet into the container for admitting a batch of explosive from a supply thereof into the container;

an explosive outlet from the container for permitting one or more charges of explosive to issue from the container; and a fluid inlet into the container for admitting a fluid under pressure into the container.

Features of this version of the apparatus may also be as described above, and, in particular, the apparatus may comprise a flexible hose having an inlet connected to the explosive outlet from the container and an outlet; and the apparatus may comprise a lance having an inlet connected to the outlet of the hose and having a free end remote from its inlet. The apparatus may, in an embodiment thereof, comprise separate chambers respectively for containing the batch of explosive in the container and for containing fluid under pressure for displacing explosive from the container.

Figure 2:
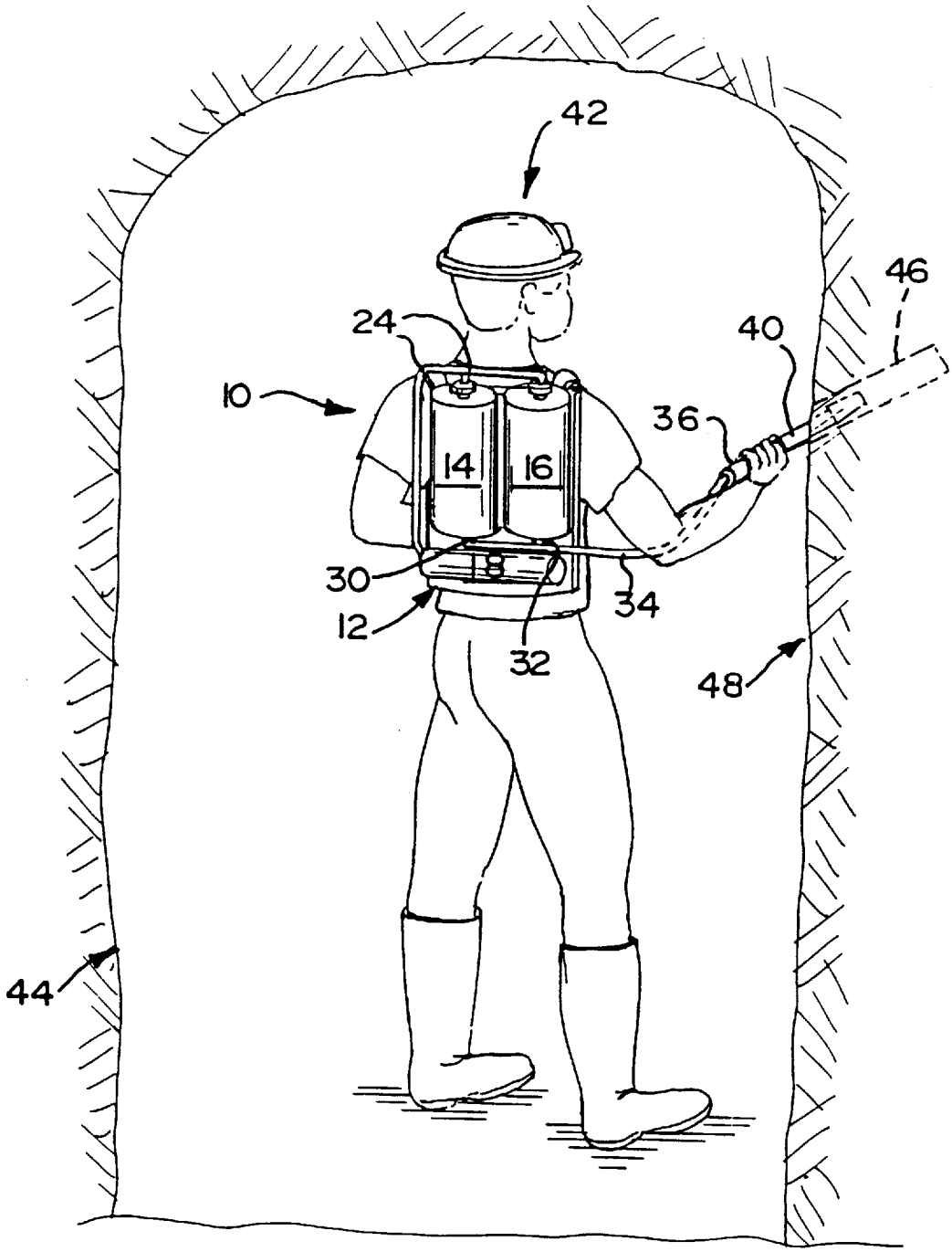

The invention will now be described by way of example with reference to the accompanying diagrammatic drawings in which:

FIG. 1 shows a schematic sectional side elevation of a portable apparatus for loading a charge of a sensitized explosive into a borehole according to the invention; and FIG. 2 shows a three-dimensional view of a person loading a sensitized explosive of the slurry or emulsion type into a borehole using the apparatus of FIG. 1.

In FIG. 1, reference numeral 10 generally designates a portable apparatus according to the invention. The apparatus 10 is in the form of a back pack 12, comprising a pair of pressurizable containers 14, 16, and a high pressure air cylinder 18, pressurized to 20 000 kPa. Each container 14, 16 contains approximately 10 kg of chemically gassed explosive of the slurry or emulsion type (not shown) and is charged to a pressure of 450 kPa.

The cylinder 18 has a high pressure air outlet flow line 20 leading to a pressure regulator 22. The regulator 22 has an air outlet flow line 24 leading respectively to the containers 14, 16. An optional intermediate pressure mine air supply feed line 25 (broken lines) is shown releasably connected to the flow line 24 by means of a releasable coupling 27.

A pressure gauge 26 is connected to flow line 24 via line 28. The containers 14, 16 have emulsion explosive outlet flow lines 30, 32 respectively. The flow lines 30, 32 are connected to and feed into an emulsion explosive feed line 34 which in turn leads to an explosives control valve 36. The control valve 36 has an emulsion explosive discharge line 38 in the form of an explosives charging lance (not shown in FIG. 1).

In FIG. 2 the same reference numerals designate the same parts as in FIG. 1, unless otherwise specified. The apparatus is illustrated attached to a user 42 thereof. In FIG. 2 an explosives charging lance 40 is shown leading from the control valve 36. The user 42 is in a mine tunnel 44. The mine tunnel 44 has a borehole 46 located in a stope wall 48 thereof.

In use, high pressure air from the cylinder 18 is reduced to a pressure of approximately 400–600 kPa in the regulator 22 before being fed into the containers 14, 16 via flow line 24 with the pressure gauge 26 (not shown in FIG. 2) indicating the pressure in the containers 14, 16. The emulsion explosive is desensitized by maintaining the pressure in the containers 14, 16 at a constant pressure of 400–600 kPa.

Desensitized explosive is fed via flow lines 30, 32 from the containers 14, 16 respectively into feed line 34. The desensitized explosive is then fed via the control valve 36 through the charging lance 40, in response to manipulation of the control valve 36 by the user 42, into the borehole 46. The user 42 controls the quantity of explosive fed into the borehole 46 by means of the control valve 36. Naturally, as the explosive is discharged into the borehole 46, there will be a concomitant decrease in pressure in the containers 14, 16 which pressure change is sensed by the regulator 22 which, in turn, compensates for the decrease in pressure by feeding pressurized air from the cylinder 18 via flow line 24 into the containers 14, 16. If the cylinder 18 is empty or if no high pressure cylinders are available, pressurized mining air at 400–600 kPa can be connected to the flow line 24 via the releasable coupling 27 to pressurize the containers 14, 16.

When the desensitized explosive is charged into the borehole 46, the relief of pressure allows the explosive to resensitize, which sensitized explosive can then be detonated in the borehole 46 by means of a suitable detonator (not shown).

The invention is now described by way of illustration with reference to the following non-limiting example.

EXAMPLE

A 150 mm×500 mm plastic airtight back pack according to FIG. 2 fitted with a 4 m×25 mm HDPE (high density polyethylene) charging lance was filled with 20 kg of chemically gassed desensitized explosive emulsion. The cylinders 14, 16, each holding 10 kg of emulsion, were pressurized to 450 kPa to prevent regassing of the emulsion. The pressure of 450 kPa prevented the emulsion from gassing to a density lower than 1,42 g/cm$^3$. At this pressure the emulsion was found to be stable for several days.

Ten minutes after filling and pressurizing the cylinders 14, 16, the discharge valve was opened and emulsion at a rate of 4 kg/minute was forced through the charging lance. The initial density of the discharged emulsion was 1,38 g/cm which dropped to a detonatable density of 1,15 g/cm$^3$ after 30 minutes. The emulsion was discharged from the cylinders 14, 16 at regular time intervals during the 24 hour period after the filling of the back pack. The measured densities of the discharged emulsion at the abovementioned time intervals were all approximately 1,15 g/cm$^3$.

It was found that if the pressure in the cylinders 14, 16 was relieved by discharging emulsion therefrom, any tendency for the density of the emulsion in the back pack to decrease was immediately compensated for by pressurized air which entered the cylinders 14, 16 from the cylinder 18, so that the density of the emulsion in the cylinders remained at values of $\geqq$1,42 g/cm$^3$. It was also noted that such discharge cycles did not materially affect the density of the emulsion in the back pack.

In tests carried out by the Applicant it has been found that when the containers 14, 16 (FIG. 2) contain a pre-gassed sensitized explosive, the explosive can be discharged from the cylinders through a flexible borehole charging hose having a length of 4 m and an internal diameter of 25 mm at a rate of 5 kg/min by feeding compressed air into the cylinder at a pressure of 5 bar (about 505 Kpa). It was found that this rate of 5 kg/min could be altered by changing the compressed air pressure and by changing the length of the hose.

In further tests, when a pre-gassed emulsion explosive was charged into the back-pack and pressurized to desensitize it, subsequent gassing times of 10–30 minutes were found to be necessary to reduce the 1,42 g/cm$^2$ density of the desensitized explosive to a density of 1,12 g/cm$^2$ to resensitize it. This variation in gassing times appeared to be largely due to different temperatures in the explosive, which temperatures varied from 10° C. to 18° C.

It was found that the desensitized product could be stored under pressure for up to 48 hours without any adverse results; and the resensitized product could be charged into 29 mm internal diameter PVC pipes and detonated with a 4D detonator containing 90 mg PETN (pentaerythritol tetranitrate) or the equivalent, to achieve an average velocity of detonation of 3879 m/s.

The method and apparatus of the present invention can produce a product suitable for use in loading boreholes with a sensitized explosive of the slurry or emulsion types. Advantageous features of the method and apparatus include the portability of the apparatus, increased safety as the explosive is conveyed in a desensitized state, ease of loading the explosive into boreholes and the relatively fast resensitizing of the explosive once it has been loaded into the borehole. A particular advantage of the invention is that no external gas supply is needed if the apparatus includes a high pressure cylinder and, if not, a readily available mine air supply can be employed. A further particular advantage of the invention is that the emulsion explosive is kept in a safe non-detonatable form until required for use and the apparatus and method is suitable for use in isolated and remote sites in mines.

We claim:

1. A method of loading a sensitized flowable explosive into a borehole, the method comprising the steps of:

dispersing a plurality of gas bubbles in an explosive base to provide a sensitized explosive;

feeding a batch of the sensitized explosive into a portable container;

subjecting the batch of explosive in the container to an elevated pressure to desensitize it;

conveying the portable container containing desensitized explosive to a borehole;

loading the borehole with explosive from the container while relieving the pressure on the explosive to resensitize the explosive as it is loaded into the borehole; and displacing the explosive from the container by means of a fluid under pressure which includes feeding a gas under pressure into the container together with the batch to provide, in the container, in addition to the batch of explosive, a gas space containing gas under said elevated pressure, the gas in the gas space being used to displace the explosive from the container.

2. A method as claimed in claim 1, in which subjecting the batch to the elevated pressure is effected after the feeding of the batch into the container.

3. A method as claimed in claim 1, in which subjecting the batch to the elevated pressure is effected during the feeding of the batch into the container.

4. A method as claimed in claim 1 in which the explosive base is an emulsion base having an aqueous phase containing ammonium ions, dispersing the bubbles in the explosive base being by dispersing a solution of nitrite ions in the base, nitrite ions in the dispersed solution reacting with ammonium ions in the aqueous phase in accordance with the reaction:

$$NH^+_4+NO^-_2 \rightarrow 2H_2O+N_2$$

to produce dispersed gas bubbles in the form of nitrogen bubbles in the base.

5. A method as claimed in claim 1 in which the dispersing of the bubbles is into a bulk supply of explosive base, the method including feeding a plurality of batches of the sensitized explosive from the bulk supply into a plurality of said portable containers.

6. A method as claimed in claim 1 in which the elevated pressure has a value of 450–600 kPa.

7. A method as claimed in claim 1 in which conveying the container to the borehole is on the back of a person, the container being carried as a back-pack by said person.

8. A method as claimed in claim 1 in which loading the borehole is by means of a lance connected to the container by a flexible hose.

9. A method as claimed in claim 1, which includes using markings along the length of the lance to monitor the quantity of explosive loaded into the borehole, the method including inserting an end of the lance remote from the hose into the borehole, displacing explosive from the container along the lance into the borehole, allowing explosive entering the borehole along the lance to displace the lance from the borehole, and discontinuing the loading when the lance has been displaced from the borehole by a degree corresponding to the loading of a desired charge of explosive into the borehole.

* * * * *